US007052111B2

(12) United States Patent
Otsuki

(10) Patent No.: US 7,052,111 B2
(45) Date of Patent: May 30, 2006

(54) PRINTING WITH CARTRIDGE EXCHANGE

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/885,940

(22) Filed: Jul. 6, 2004

(65) Prior Publication Data

US 2004/0239722 A1 Dec. 2, 2004

Related U.S. Application Data

(63) Continuation of application No. 10/146,253, filed on May 13, 2002, now Pat. No. 6,805,428.

(30) Foreign Application Priority Data

May 15, 2001 (JP) ..... 2001-144569

(51) Int. Cl.
*B41J 2/145* (2006.01)
*B41J 2/15* (2006.01)
*B41J 2/015* (2006.01)

(52) U.S. Cl. ..... 347/40; 347/21

(58) Field of Classification Search ..... 347/43, 347/40, 20, 21

See application file for complete search history.

(56) References Cited

U.S. PATENT DOCUMENTS 6,334,666 B1 * 1/2002 Inui et al. ..... 347/43
6,412,935 B1 * 7/2002 Doumaux ..... 347/99
6,568,790 B1 * 5/2003 Sugiyama ..... 347/43

* cited by examiner

*Primary Examiner*—Thinh Nguyen
(74) *Attorney, Agent, or Firm*—Martine Penilla & Gencarella LLP

(57) ABSTRACT

The printing apparatus of the present invention includes a print head that has basic-color nozzle arrays and a specific nozzle array disposed in a staggered manner in relation to a black ink nozzle array, which is one of the basic-color nozzle arrays. The specific nozzle array can receive a solution independently of the basic-color nozzle arrays, and the solution can be selected from a plurality of solutions (including black ink) by selecting a specific cartridge mounted in a ink feeder. Images can be printed in black and white at a high speed with the aid of the two nozzle arrays (black ink nozzle array and specific nozzle array) by selecting black ink for the solution. Higher picture quality can also be obtained during photographic printing by selecting, for example, a dark yellow ink or a gray ink as the solution.

4 Claims, 12 Drawing Sheets

S: K or DY

S: K or DY

First Embodiment

Second Embodiment

*Fig. 11A* A Protective Agent X

| Type of Print Medium | Suitability of Protective Agent | Ejection Method |
|---|---|---|
| Print Medium A | × | — |
| Print Medium B | ○ | During Printing |
| Print Medium C | ○ | Before Printing |
| Print Medium D | ○ | Before Printing |

*Fig. 11B* B Protective Agent Y

| Type of Print Medium | Suitability of Protective Agent | Ejection Method |
|---|---|---|
| Print Medium A | ○ | After Printing |
| Print Medium B | ○ | After Printing |
| Print Medium C | × | — |
| Print Medium D | ○ | Before Printing |

PRINTING WITH CARTRIDGE EXCHANGE

CROSS REFERENCE TO RELATED APPLICATIONS

This application claims priority under 35 U.S.C. § 120 as a continuation of U.S. application Ser. No. 10/146,253, filed May 13, 2002 now U.S. Pat. No. 6,805,428, the disclosure of which is incorporated herein by reference.

BACKGROUND OF THE INVENTION

1. Field of the Invention

The present invention relates to a technique for printing images on a print medium by ejecting ink drops.

2. Description of the Related Art

Printing apparatus (hereinafter "ink-jet printing apparatus") for forming ink dots and printing images on print media by ejecting ink drops are widely used as output devices for computer-created images. The print head of an ink-jet printing apparatus is provided with a plurality of nozzle groups, and these nozzle groups eject mutually different inks in a corresponding manner.

In conventional ink-jet printing apparatus, the color of the ink ejected by each nozzle group is predetermined, and no consideration had been given to the possibility of varying this color in an effective way in order to achieve improved printing performance.

SUMMARY OF THE INVENTION

Accordingly, an object of the present invention is to improve printing performance by changing the ink colors ejected by the nozzle groups of a print head.

In order to attain the above and the other objects of the present invention, there is provided a printing apparatus for ejecting ink drops to form dots on a print medium during main scan. The printing apparatus comprises a cartridge mounting section, and a print head, an ink feeder. The cartridge mounting section is capable of mounting an ink tank set storing four basic-color inks of black, cyan, magenta, and yellow, and a supplementary cartridge storing a supplementary solution. The print head has four basic-color nozzle arrays for ejecting the four basic-color inks, respectively, and a supplementary nozzle array for ejecting the supplementary solution. The four basic-color nozzle arrays include a black ink nozzle array for ejecting the black ink. The ink feeder is capable of feeding the four basic-color inks to the four basic-color nozzle arrays, while feeding the supplementary solution from the supplementary cartridge to the supplementary nozzle array. The ink feeder feeds the supplementary solution independently from the basic-color nozzle arrays. The supplementary nozzle array is offset from the black ink nozzle array in a sub-scan direction. The supplementary solution is selectable from a plurality of types of solutions including the black ink.

The printing apparatus will attain high-speed black-and-white printing using the two nozzle arrays (black ink nozzle array and supplementary nozzle array) by selecting black ink for the solution. The quality of photographic images can also be improved by selecting dark yellow ink or gray ink for this solution.

The present invention can be realized in various forms such as a method and apparatus for printing, a method and apparatus for producing print data for a printing unit, a print head, a cartridge, a combination of cartridges, and a computer program product implementing the above scheme.

These and other objects, features, aspects, and advantages of the present invention will become more apparent from the following detailed description of the preferred embodiments with the accompanying drawings.

BRIEF DESCRIPTION OF THE DRAWINGS

FIGS. 11A and 11B are diagrams depicting a method for ejecting a protective agent during a printing procedure in accordance with the second embodiment of the present invention.

DESCRIPTION OF THE PREFERRED EMBODIMENT

The present invention is explained in the following sequence based on embodiments.

A. Apparatus Structure:

B. Printing Procedure of First Embodiment

C. Printing Procedure of Second Embodiment

D. Modifications

A. Apparatus Structure

Figure 1:
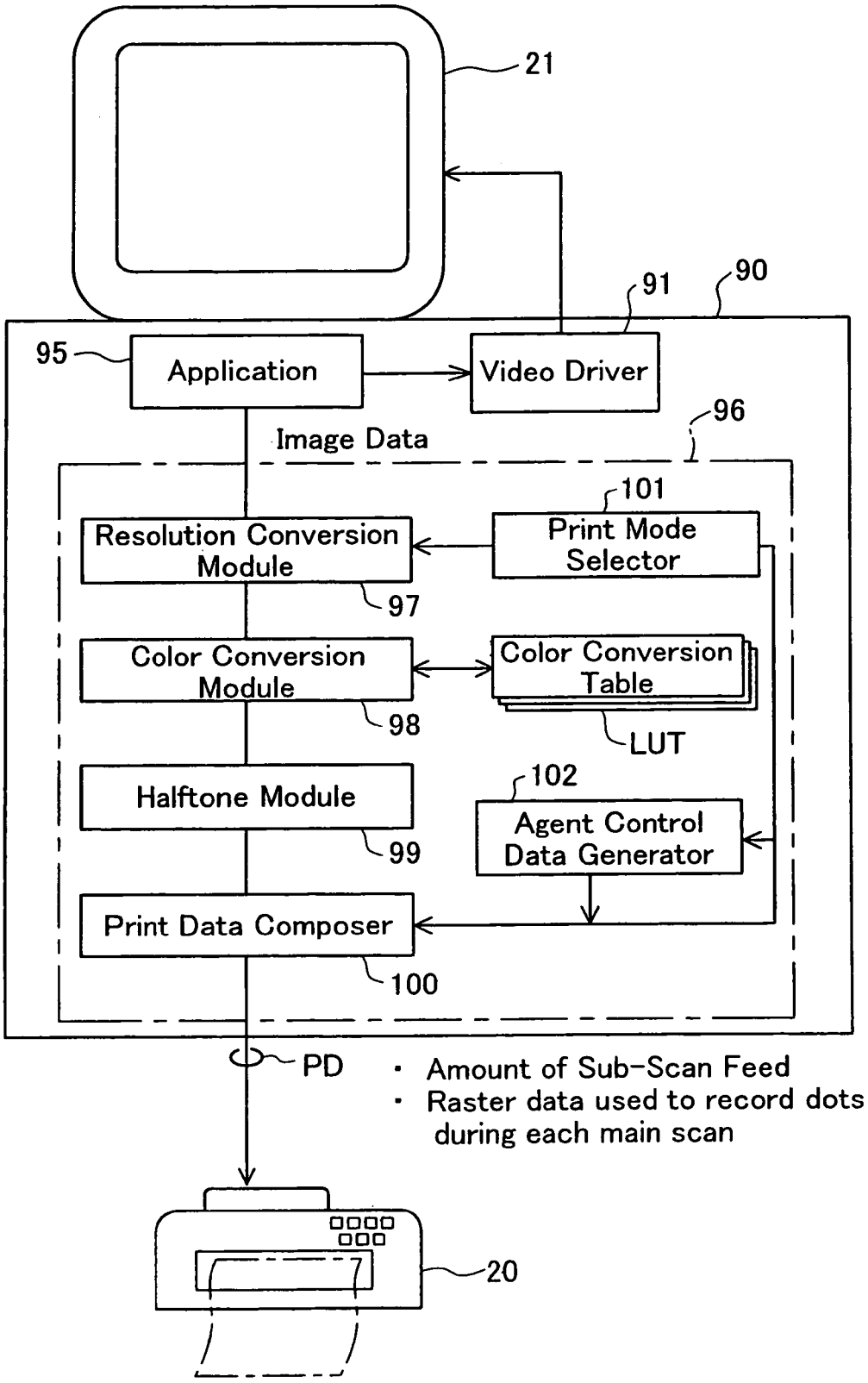
FIG. 1 is a block diagram depicting the structure of a printing system as an embodiment of the present invention.

FIG. 1 is a block diagram that shows the structure of a printing system as an embodiment of the present invention. This printing system has a computer 90 as a printing control apparatus, and a color printer 20 as a printing unit. The combination of color printer 20 and computer 90 can be called a "printing apparatus" in its broad definition.

Application program 95 operates on computer 90 under a specific operating system. Video driver 91 and printer driver 96 are incorporated in the operating system, and print data PD to be sent to color printer 20 is output via these drivers from application program 95. Application program 95 performs the desired processing on the image to be processed, and displays the image on CRT 21 with the aid of video driver 91.

When application program 95 issues a print command, printer driver 96 of computer 90 receives image data from application program 95, and converts this to print data PD to supply to color printer 20. In the example shown in FIG. 1, printer driver 96 includes resolution conversion module 97, color conversion module 98, Halftone module 99, print data composer 100, print mode selector 101, agent control data generator 102, and color conversion table LUT.

Resolution conversion module 97 has the role of converting the resolution (in other words, the pixel count per unit length) of the color image data handled by application program 95 to resolution that can be handled by printer driver 96. Image data that has undergone resolution conversion in this way is still image information made from the three colors RGB. Color conversion module 98 converts RGB image data to multi-tone data of multiple ink colors that can be used by color printer 20 for each pixel while referencing color conversion table LUT. The reason why multiple color conversion tables are equipped will be described below.

The color converted multi-tone data can have a tone value of 256 levels, for example. Halftone module 99 executes halftone processing to express this tone value on color printer 20 by distributing and forming ink dots. Image data that has undergone halftone processing is realigned in the data sequence in which it should be sent to color printer 20 by print data composer 100, and ultimately is output as print data PD. Print data PD includes raster data that shows the dot recording state during each main scan and data that shows the sub-scan feed amount. The functions performed by print mode selector 101 and agent control data generator 102 will be described below.

Printer driver 96 is a program for realizing a function that generates print data PD. A program for realizing the functions of printer driver 96 is supplied in a format recorded on a recording medium that can be read by a computer. As this kind of recording medium, any variety of computer readable medium can be used, including floppy disks, CD-ROMs, opt-magnetic disks, IC cards, ROM cartridges, punch cards, printed items on which a code such a bar code is printed, a computer internal memory device (memory such as RAM or ROM), or external memory device, etc.

Figure 2:
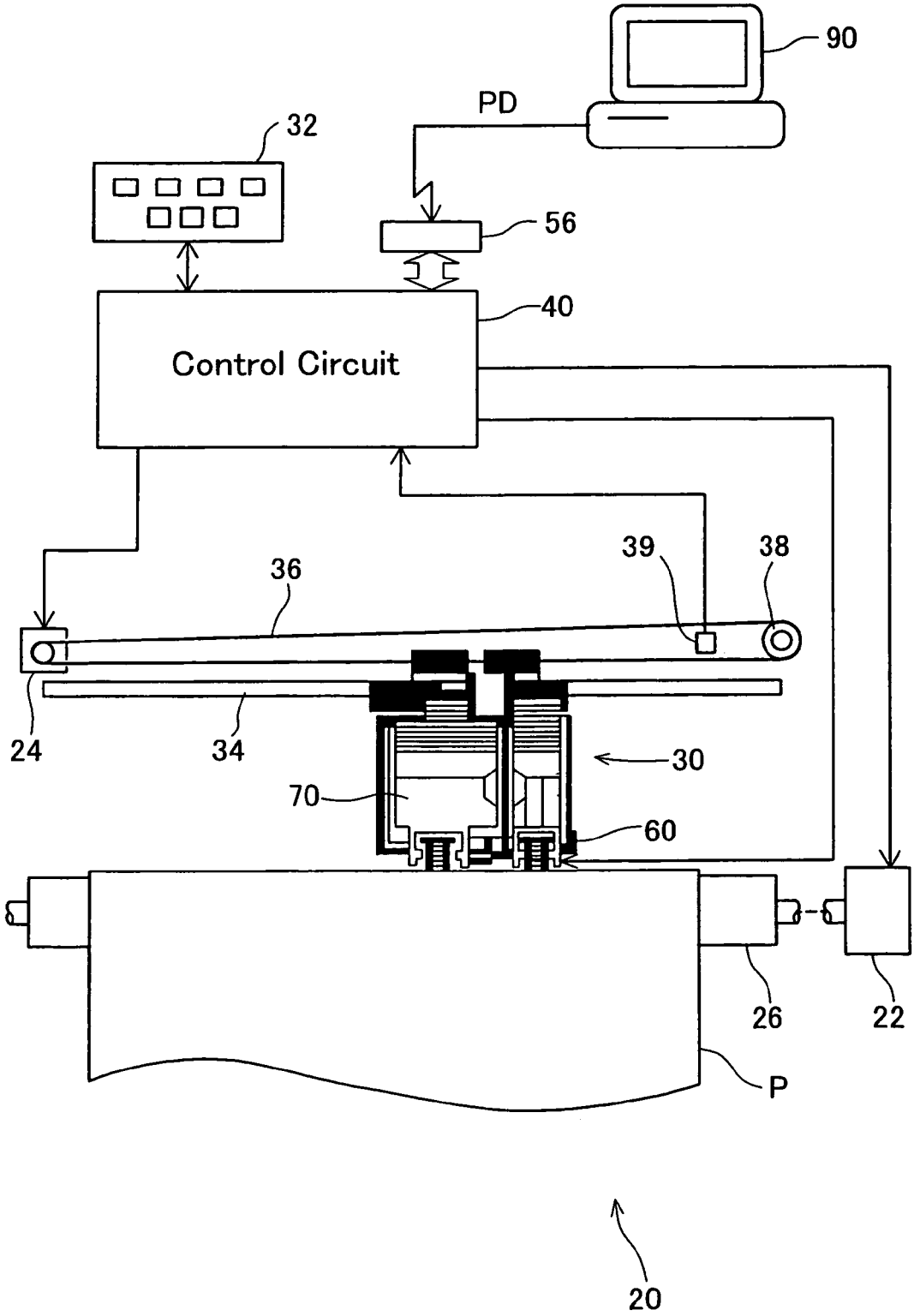
FIG. 2 is a diagram depicting the printer structure.

FIG. 2 is a schematic structural diagram of color printer 20. Color printer 20 is equipped with a sub-scan feed mechanism that carries printing paper P in the sub-scanning direction using paper feed motor 22, a main scan feed mechanism that sends cartridge 30 back and forth in the axial direction of platen 26 using carriage motor 24, a head driving mechanism that drives printing head unit 60 built into carriage 30 and controls ink ejecting and dot formation, and control circuit 40 that controls the interaction between the signals of paper feed motor 22, carriage motor 24, printing head unit 60, and operating panel 32. Control circuit 40 is connected to computer 90 via connector 56.

The sub-scan feed mechanism that carries printing paper P is equipped with a gear train (not illustrated) that transmits the rotation of paper feed motor 22 to paper carriage roller (not illustrated). Also, the main scan feed mechanism that sends carriage 30 back and forth is equipped with sliding axis 34 on which is supported carriage 30 so that it can slide on the axis and that is constructed in parallel with the axis of platen 26, pulley 38 on which is stretched seamless drive belt 36 between the pulley and carriage motor 24, and position sensor 39 that detects the starting position of carriage 30.

Figure 3:
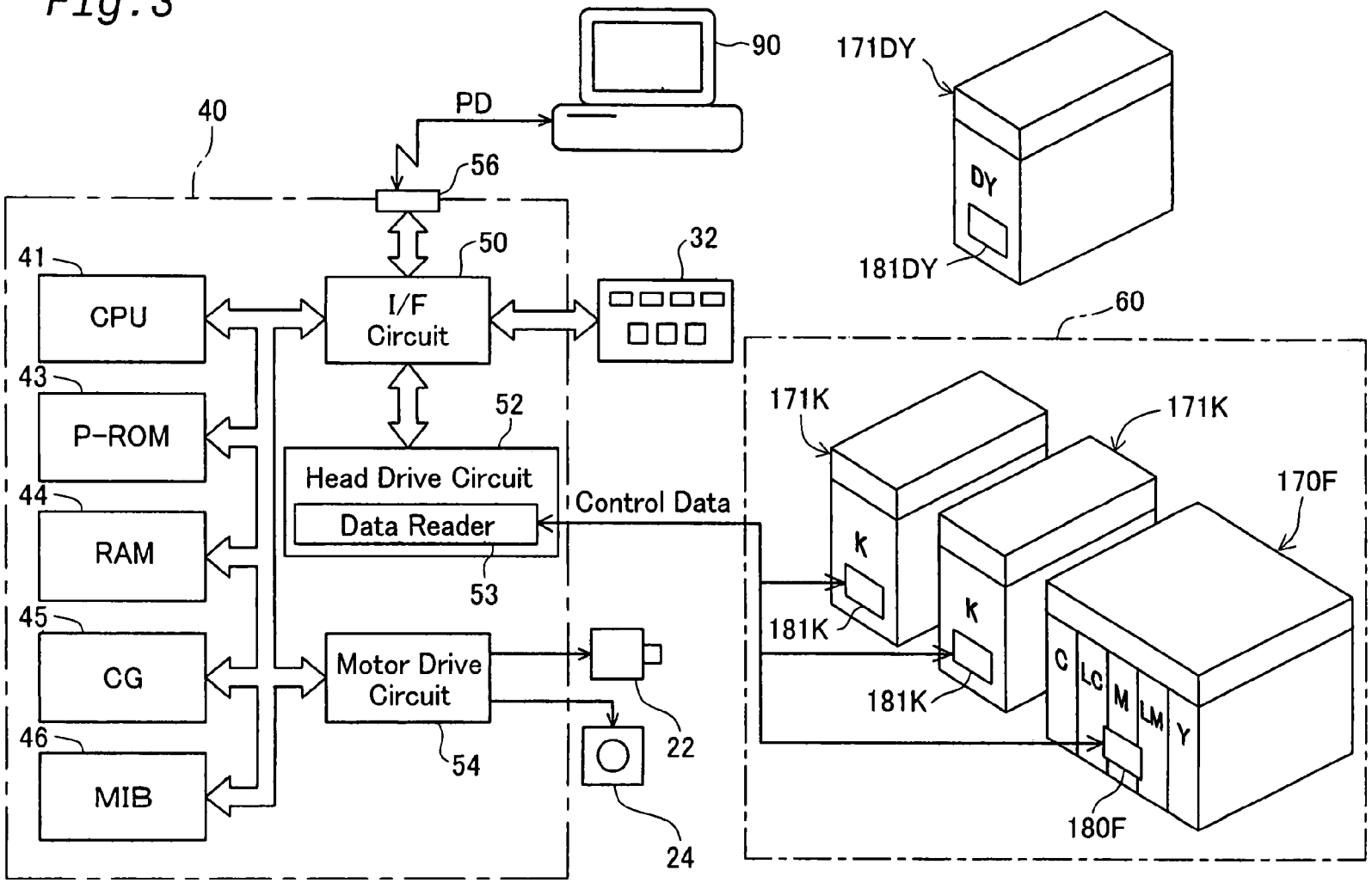
FIG. 3 is a block diagram depicting the structure of the control circuit 40 in the color printer 20.

FIG. 3 is a block diagram depicting the structure of a color printer 20 based on a control circuit 40. The control circuit 40 is composed of an arithmetic Boolean circuit comprising a CPU 41, a programmable ROM (PROM) 43, a RAM 44, a character generator (CG) 45 containing dot matrices for characters, and an MIB (Management Information Base) 46, which is a database for maintaining the operating environment of the color printer 20. The control circuit 40 further comprises a I/F circuit 50 for creating a interface with external motors and so on, a head drive circuit 52 connected to the I/F circuit 50 and designed to eject ink by actuating a print head unit 60, and a motor drive circuit 54 for actuating a paper feed motor 22 and a carriage motor 24.

The I/F circuit 50 contains a parallel interface circuit and is capable of receiving print data PD from the computer 90 via a connector 56. The color printer 20 prints images in accordance with the print data PD. RAM 44 functions as a buffer memory for the temporary storage of raster data. The computer 90 can obtain information about the operating environment of the printer 20 by accessing the MIB 46. The operating environment contains information about the mounted cartridge.

The print head unit 60 has a print head 28 and can accommodate ink cartridges. The print head unit 60 can be mounted on the color printer 20 and removed as a single component. In other words, the print head unit 60 is replaced when the print head 28 needs to be replaced.

The print head unit 60 supports two black ink cartridges 171K and a single color ink cartridge 170F. The black ink cartridges 171K and color ink cartridge 170F are provided with memory 181K and memory 180F, respectively. The memory 181K and memory 180F contain ink information that identifies the types of ink stored in the ink cartridges. The ink information is read by a data reader 53 and sent to the computer 90 via the I/F circuit 50 and the connector 56. The memory 181K and memory 180F may also contain various types of information related to the effective expiration date of the stored ink, the amount of remaining ink and so on.

A dark yellow ink cartridge 171DY for storing dark yellow ink can be mounted instead of one of the black ink cartridges 171K on the present printing apparatus. As used herein, the term "dark yellow ink" refers to an ink whose brightness is less than that of the yellow ink. The term may also refer to dark yellow ink. Specifically, a dark yellow ink is an ink obtained by mixing yellow ink with colorants for other inks (for example, dark cyan and dark magenta). Using a dark yellow ink containing a dark cyan component and a dark magenta component allows less ink (particularly less solvent) to be ejected onto the print medium in comparison with the use of separately ejected ink drops comprising yellow, dark cyan, and dark magenta. A resulting advantage is that print quality can be improved, particularly in shadow areas.

Figure 4:
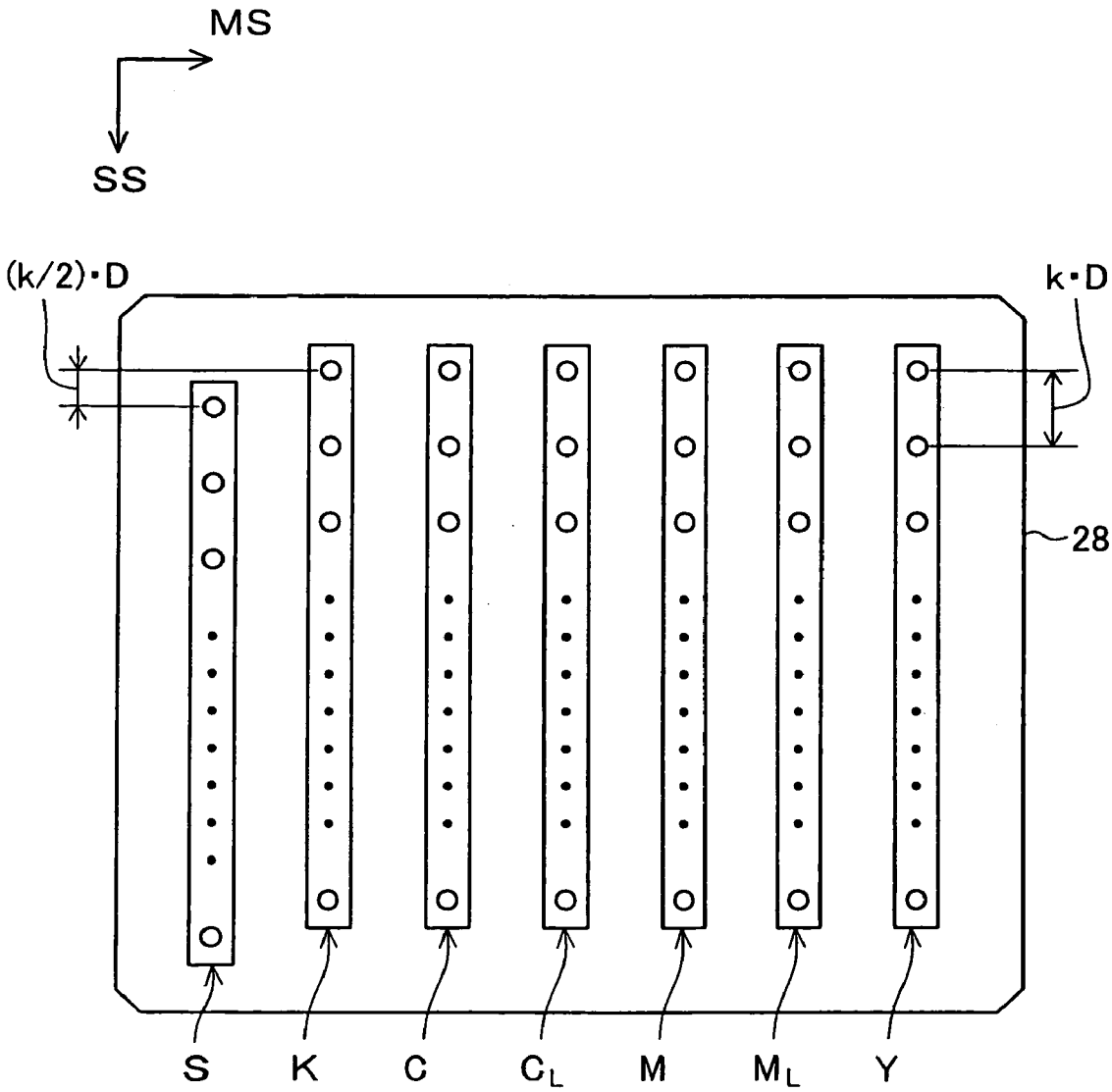
FIG. 4 is a diagram depicting the arrangement of nozzles on the lower surface of the print head 28.

FIG. 4 is a diagram illustrating the arrangement of nozzles on the lower surface of the print head 28. The lower surface of the print head 28 is provided with the following nozzles for ejecting color inks: a cyan ink nozzle array C for ejecting cyan ink, a light cyan ink nozzle array $C_L$ for ejecting light cyan ink, a magenta ink nozzle array M for ejecting magenta ink, a light magenta ink nozzle array $M_L$ for ejecting light magenta ink, and a yellow ink nozzle array Y for ejecting yellow ink. The surface is also provided with the following nozzles capable of ejecting black ink: a black ink nozzle array K for ejecting black ink, and a supplementary nozzle array S for ejecting a supplementary ink that can be selected from black ink and dark yellow ink.

In the present specification, the four non-light inks C, M, Y, and K are referred to as "four basic inks." More specifically, the term "four basic inks" refers to a cyan ink, a magenta ink, a yellow ink, and a non-gray black ink capable of reproducing a black color by being mixed in substantially equal amounts. In the present specification, the four nozzle arrays Y, M, C, and K used to eject the four basic inks are referred to as "basic-color nozzle arrays."

The plurality of nozzles in each nozzle array are arranged at a constant pitch K·D in the direction of sub-scanning SS. In the formula, K is an integer and D is a pitch (dot pitch) that corresponds to print resolution in the direction of sub-scanning.

The supplementary nozzle array S is disposed in a staggered manner in relation to the black ink nozzle array K for ejecting black ink. For this reason, selecting black ink for the supplementary ink will change the nozzle pitch of the plurality of nozzles for ejecting black ink to (k/2)×D, as can be seen in FIG. 4. As a result, the number of raster lines that can be formed by a single main scan will be twice the number obtained when dark yellow ink is selected from the supplementary ink during black-and-white printing.

Each nozzle is provided with a piezo-element (not shown) as a drive element designed to actuate the nozzle and to eject ink drops. During printing, ink drops are ejected from each nozzle while the print head 28 moves in the direction of main scanning MS.

The plurality of nozzles in each nozzle array may, for example, be arranged in a staggered configuration rather than aligned in a straight line in the direction of sub-scanning. When the nozzles are arranged in a staggered configuration, the nozzle pitch K·D in the direction of sub-scanning can still be defined in the same manner as in FIG. 4.

Figure 5A:
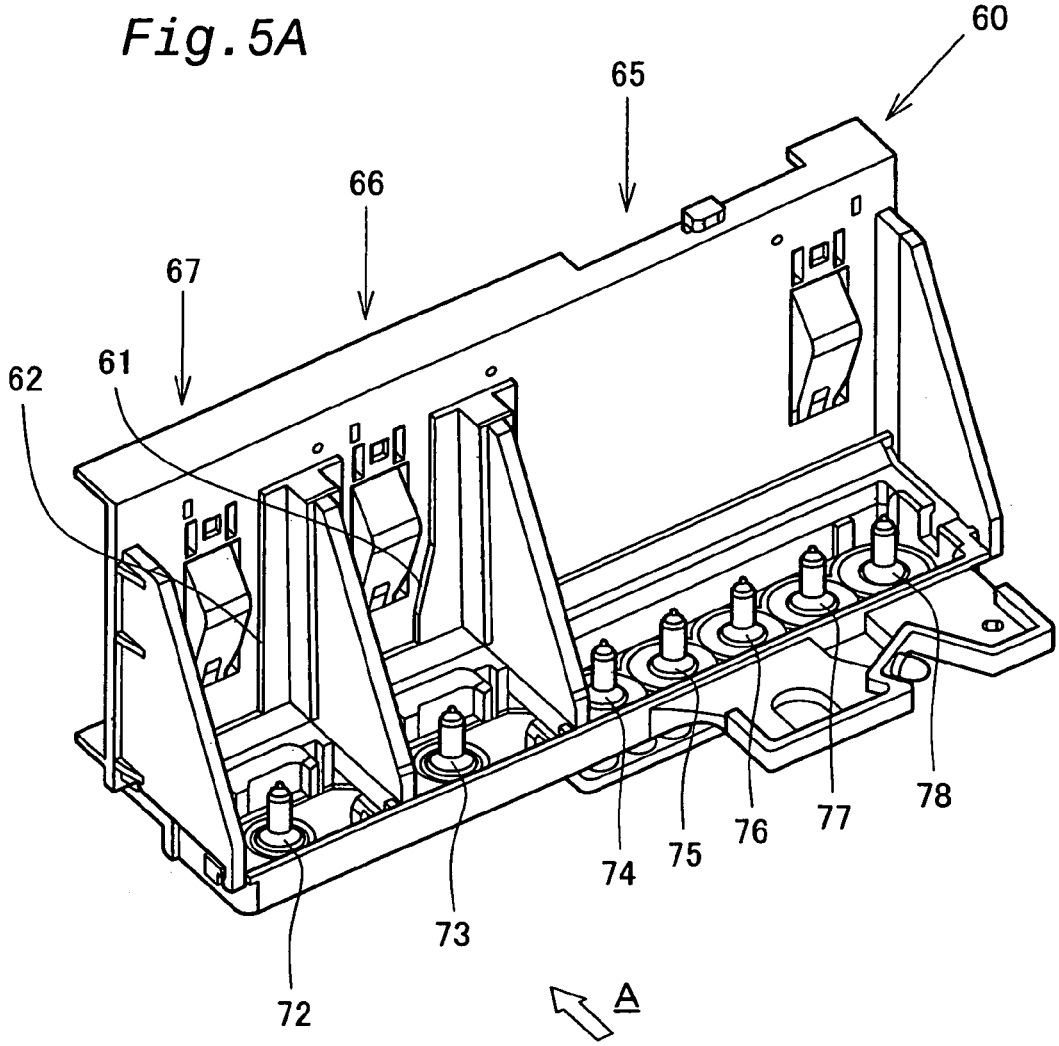
FIGS. 5A and 5B are simplified diagrams depicting the print head unit 60.

FIG. 5A is a perspective view of the print head unit 60. The print head unit 60 is equipped with a cartridge mounting section comprising a five-color ink cartridge mounting section 65, a black-ink cartridge mounting section 66, and a supplementary cartridge mounting section 67. As used herein, the term "supplementary cartridge" refers to a cartridge that has a supplementary ink tank for storing a supplementary ink to be fed to the supplementary nozzle array S. The supplementary ink can be an ink selected from black and dark yellow inks. In this embodiment, the cartridge mounting section is configured such that the supplementary cartridge can be mounted at the end of the cartridge mounting section separately from the basic-color ink cartridges. This configuration makes it easier to replace the supplementary cartridges.

The print head 28 underneath the print head unit 60 has a total of seven nozzle arrays, which correspond to the supplementary ink, black ink, and five color inks. The bottom portion of the print head unit 60 is provided with conduits 72–78 for guiding the inks from the nozzle arrays to the cartridges. Conduit 72 is designed to guide the ink from the supplementary cartridge. Conduit 73 is designed to guide the ink from the black ink cartridge. Conduits 74–78 are designed to guide the ink from the color ink cartridge.

Figure 5B:
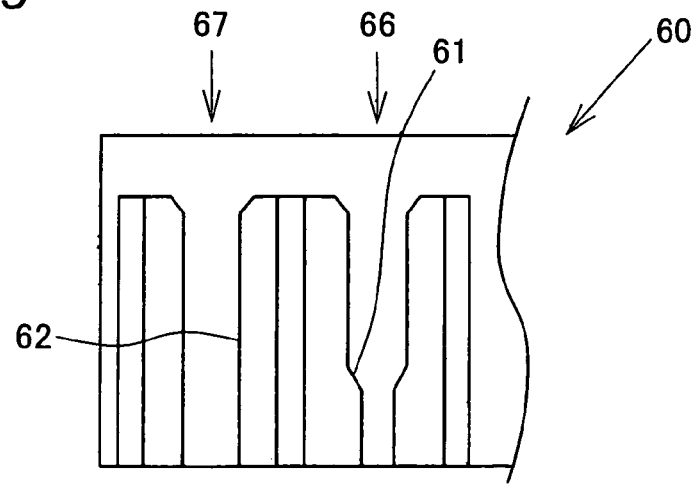

FIG. 5B is a simplified diagram of the print head unit 60 as viewed in the direction of arrow A. The print head unit 60 is provided with a black-ink cartridge mounting section 66 and a supplementary cartridge mounting section 67, as can be seen in FIGS. 5A and 5B. The black-ink cartridge mounting section 66 and the supplementary cartridge mounting section 67 are provided with cartridge guides 61,62, respectively. These cartridge guides 61,62 have mutually different configurations, as can be seen in the drawing.

Figure 6A:
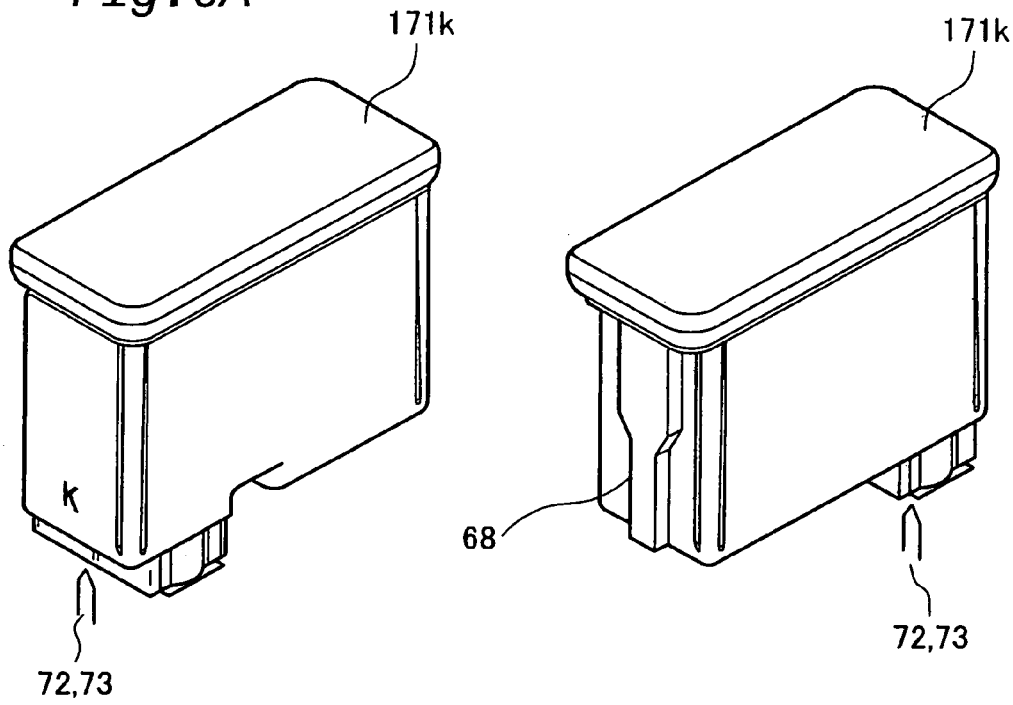
FIGS. 6A and 6B are perspective views of a black ink cartridge and a dark-yellow ink cartridge.
Figure 6B:
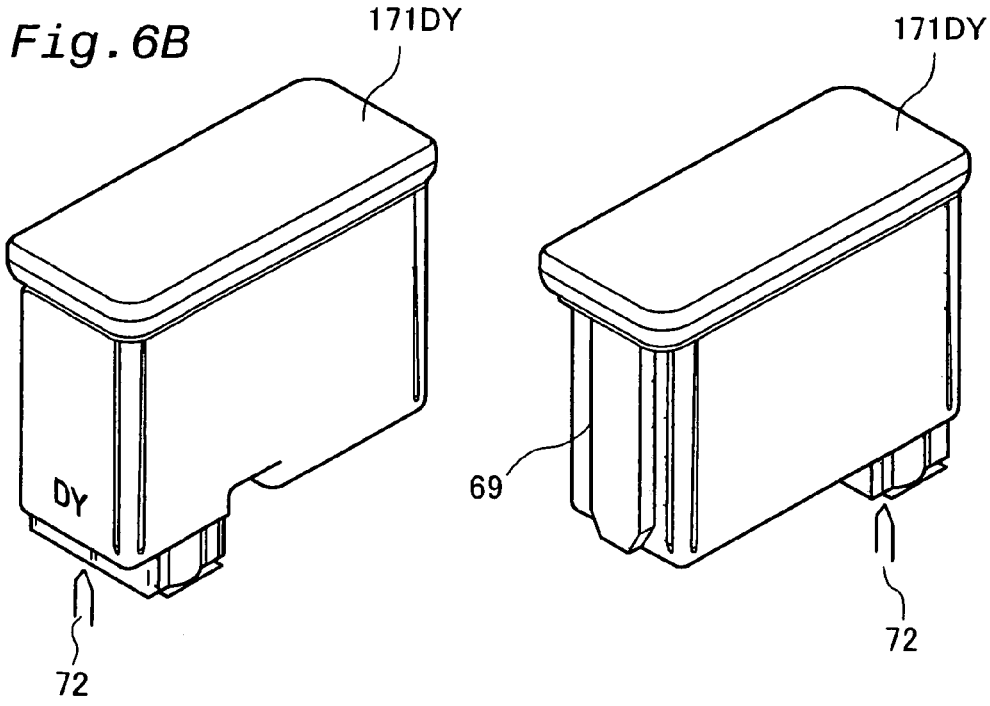

FIGS. 6A and 6B are perspective views of a black ink cartridge 171K and a dark-yellow ink cartridge 171DY. The casing of the black ink cartridge 171K is provided with a projection 68. The casing of the dark-yellow ink cartridge 171DY is provided with a projection 69.

The projection 68 with the black ink cartridge 171K can fit into the cartridge guide 61 of the print head unit 60, but the projection 69 with the dark-yellow ink cartridge 171DY cannot fit into the guide, as can be seen in FIGS. 5A, 5B, 6A, and 6B. On the other hand, either of the projection 68,69 can fit into the cartridge guides 62 of the print head unit 60. As a result, the black ink cartridge 171K alone can be mounted on the black-ink cartridge mounting section 66, whereas the dark-yellow ink cartridge 171DY cannot be mounted. On the other hand, the black ink cartridge 171K and the dark-yellow ink cartridge 171DY can both be mounted on the supplementary cartridge mounting section 67.

The configuration in which the dark-yellow ink cartridge 171DY cannot be mounted on the black ink cartridge mounting section is adopted in order to prevent the ink in the dark-yellow ink cartridge 171DY from being fed to the black ink nozzle array as a result of incorrect mounting there. On the other hand, the black ink cartridge 171K can be mounted both on the black-ink cartridge mounting section and on the supplementary cartridge mounting section. This arrangement is preferred because it gives the user greater latitude in terms of mounting the black ink cartridge 171K on either unit.

Figure 7:
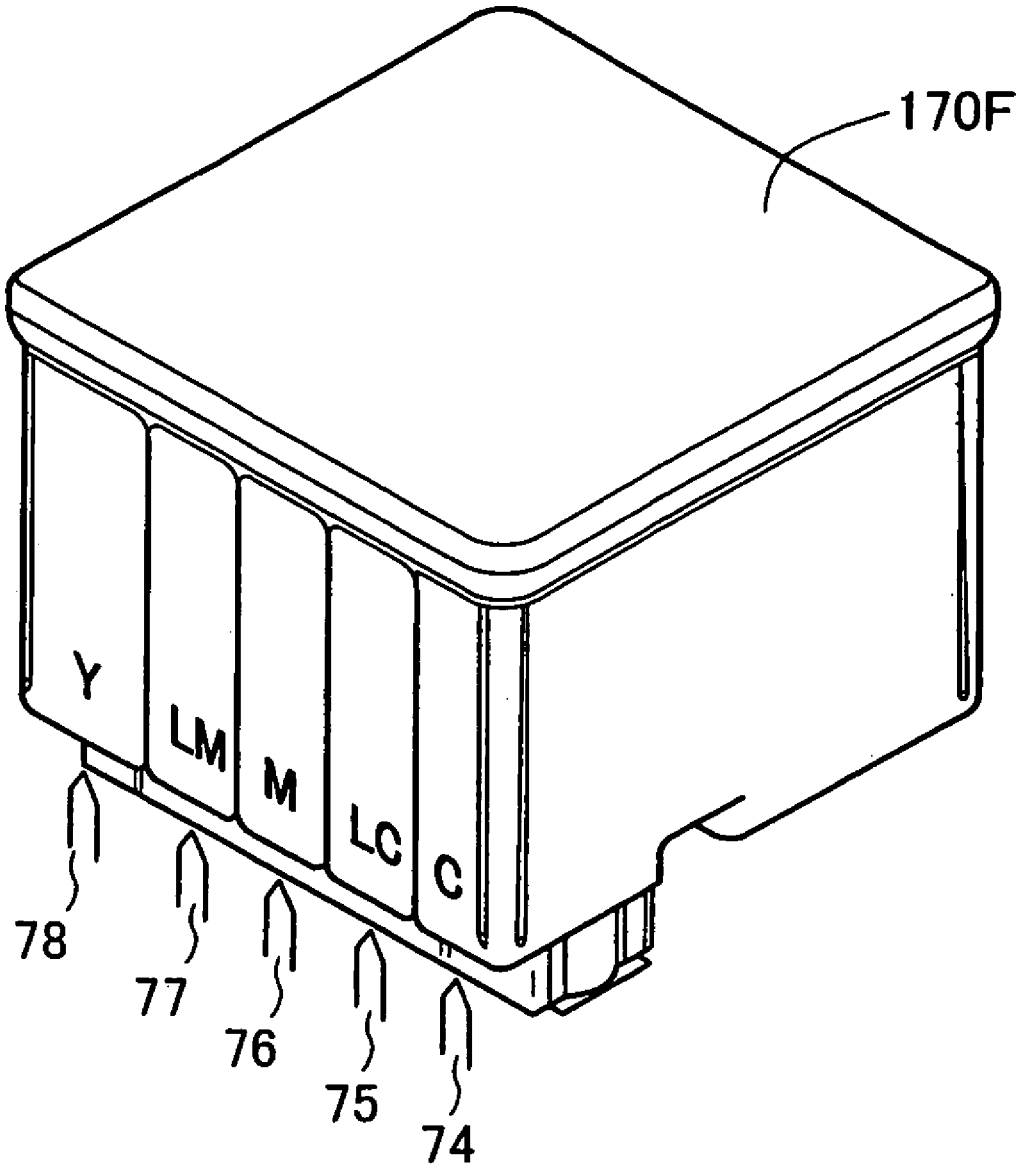
FIG. 7 is a perspective view of a color ink cartridge.

FIG. 7 is a perspective view of a color ink cartridge. This color ink cartridge 170F accommodates, in an integrated manner, the following five types of inks: cyan C, light cyan (LC), magenta (M), light magenta (LM), and yellow (Y).

The color ink cartridge 170F is obtained by integrating together five ink tanks for the five types of ink. The print head unit 60 can also be configured such that separate ink tanks designed for each type of ink are mounted on the print head unit 60 instead of the ink cartridge 170F. In this case, each ink tank is provided with memory. As can be seen in the description, the term "ink tank" used herein refers to a container for storing a single type of ink. In addition, the term "ink cartridge" refers to an integrally shaped container having at least one ink tank.

In the color printer 20 with this hardware structure, the carriage 30 is reciprocated by the carriage motor 24 while paper P is transported by the paper feed motor 22, the piezo-elements of the print head 28 are actuated at the same time, ink droplets of each color are ejected, and ink dots are formed, producing multicolored, multi-gradation images on the paper P.

B. Printing Procedure of First Embodiment

Figure 8:
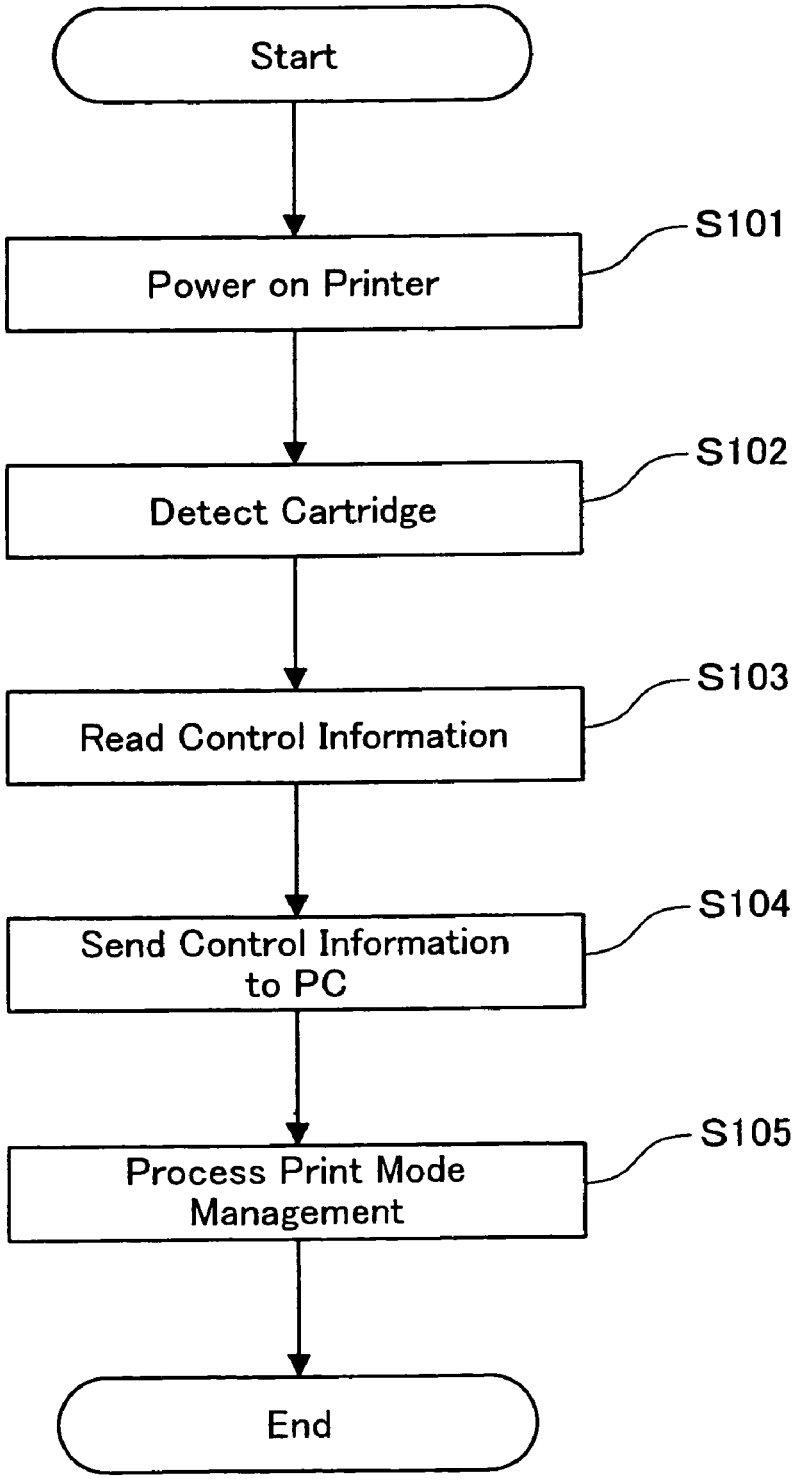
FIG. 8 is a flowchart depicting the sequence of the printing procedure performed according to a first embodiment of the present invention.

FIG. 8 is a flowchart depicting a preparation procedure for the printing procedure performed according to the first embodiment of the present invention. The preparation procedure starts automatically when the power of the color printer 20 is switched on (step S101). The preparation procedure is started in the same manner when the ink cartridge 171K or 170F (FIG. 3) gets mounted in the state in which the color printer 20 is on. In this case, the procedure is started from the subsequent step S102.

In step S102, the CPU 41 of the color printer 20 senses the presence of the ink cartridge 171K or 170F. As used herein, the term "sensing the presence of an ink cartridge" refers to determining that an electric connection has been established with the memory 181K or 180F provided to the ink cartridge 171K or 170F.

In step S103, the data reader 53 (FIG. 3) reads the control information needed to use the ink cartridges mounted on the color printer 20 from the memory 181K or 180F. The control information contains information about the type of ink stored in the ink cartridge. The control information is sent to the computer 90 (step S104) via the connector 56 (FIG. 3).

The computer 90 accesses Management Information Base (MIB) 46 and determines whether the operating environment of the printer 20 is still the same, and particularly whether the mounted cartridge has remained unchanged. If a change has occurred (for example, the supplementary cartridge has been changed from a dark yellow cartridge to a black ink cartridge), the black ink stored in the black ink cartridge is used to clean the supplementary nozzle array and the conduit 72. It is thus possible to prevent print quality from deteriorating due to the mixing of ink colors. If one type of cartridge is to be replaced with a different type of cartridge, the supplementary nozzle array should preferably be cleaned prior to the replacement with the aid of a cleaning cartridge for storing the cleaning solution used to clean the supplementary nozzle array.

In step S105, the print mode selector 101 (FIG. 1) performs a print-mode management process. The print-mode management process is performed in accordance with the type of mounted ink cartridge. Specifically, the process varies depending on whether a black ink cartridge or a dark yellow ink cartridge is mounted as the supplementary cartridge, as described below.

Mounting a black ink cartridge 171K causes a color conversion table LUT to be selected in accordance with the control information that is read from the memory 181K of the black ink cartridge 171K. The color conversion table LUT is a collection of data in which a given image value is associated with a combination of color gradation values for the plurality of inks stored in the ink cartridges 171K and 170F. In addition, the print mode selector 101 manages the print mode such that high-speed printing is maintained using two nozzle arrays (supplementary nozzle array S and black ink nozzle array K) during white-and-black printing.

The color conversion table LUT is selected in the same manner when a dark yellow ink cartridge is mounted. The color conversion table LUT is a collection of data in which a given image is associated with a combination of color gradation values for expressing this image with the aid of the plurality of inks stored in the ink cartridges 171K, 171DY, and 170F. In addition, the print mode selector 101 manages the print mode in a manner such that a print mode for performing super high-quality printing with all available inks (including the dark yellow ink) can be selected during color printing.

The computer 90 stores the updated operating environment in the MIB 46 when such a preparation procedure is completed. The printing apparatus assumes a state in which a printing procedure such as the one described below can be performed.

Figure 9:
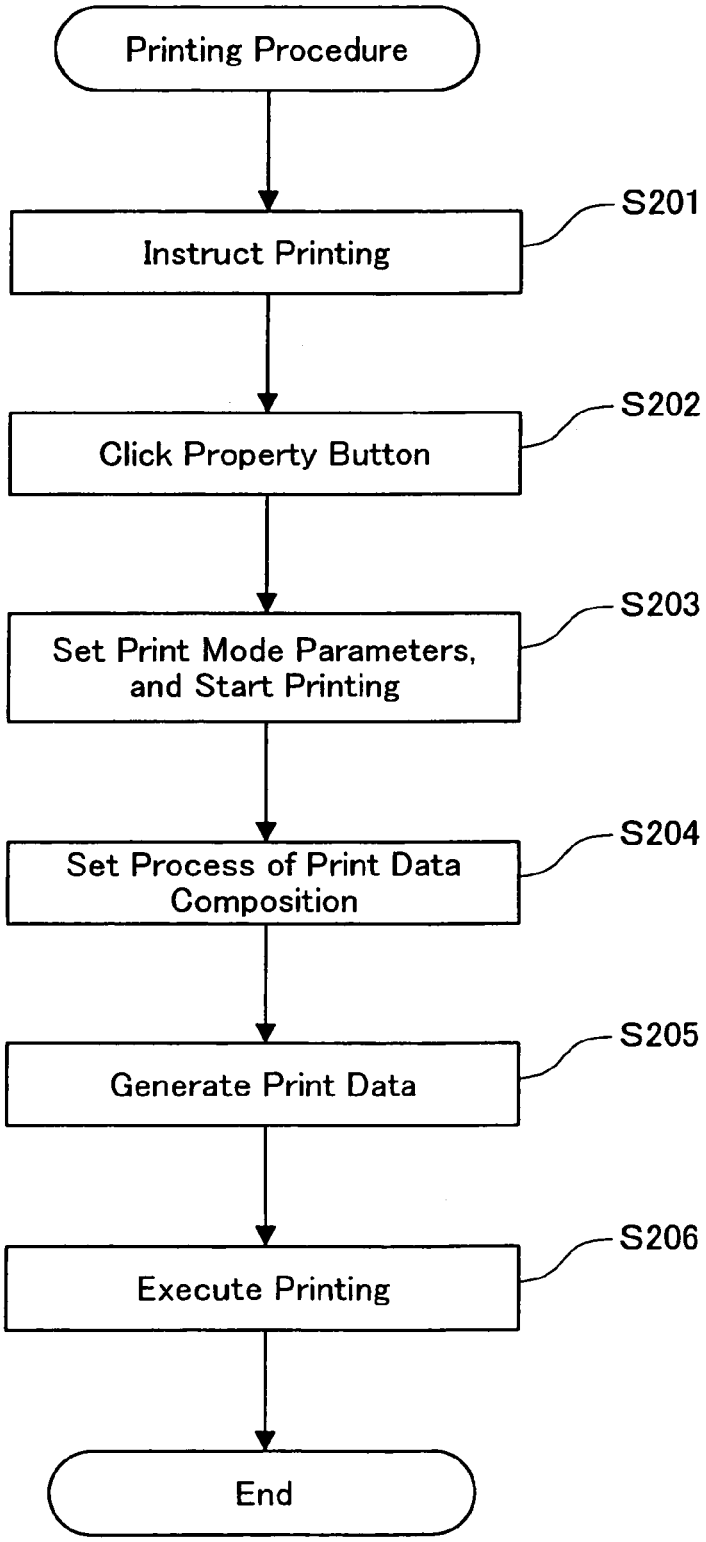
FIG. 9 is a flowchart depicting the sequence for creating and processing print data in accordance with the first embodiment of the present invention.
Figure 10:
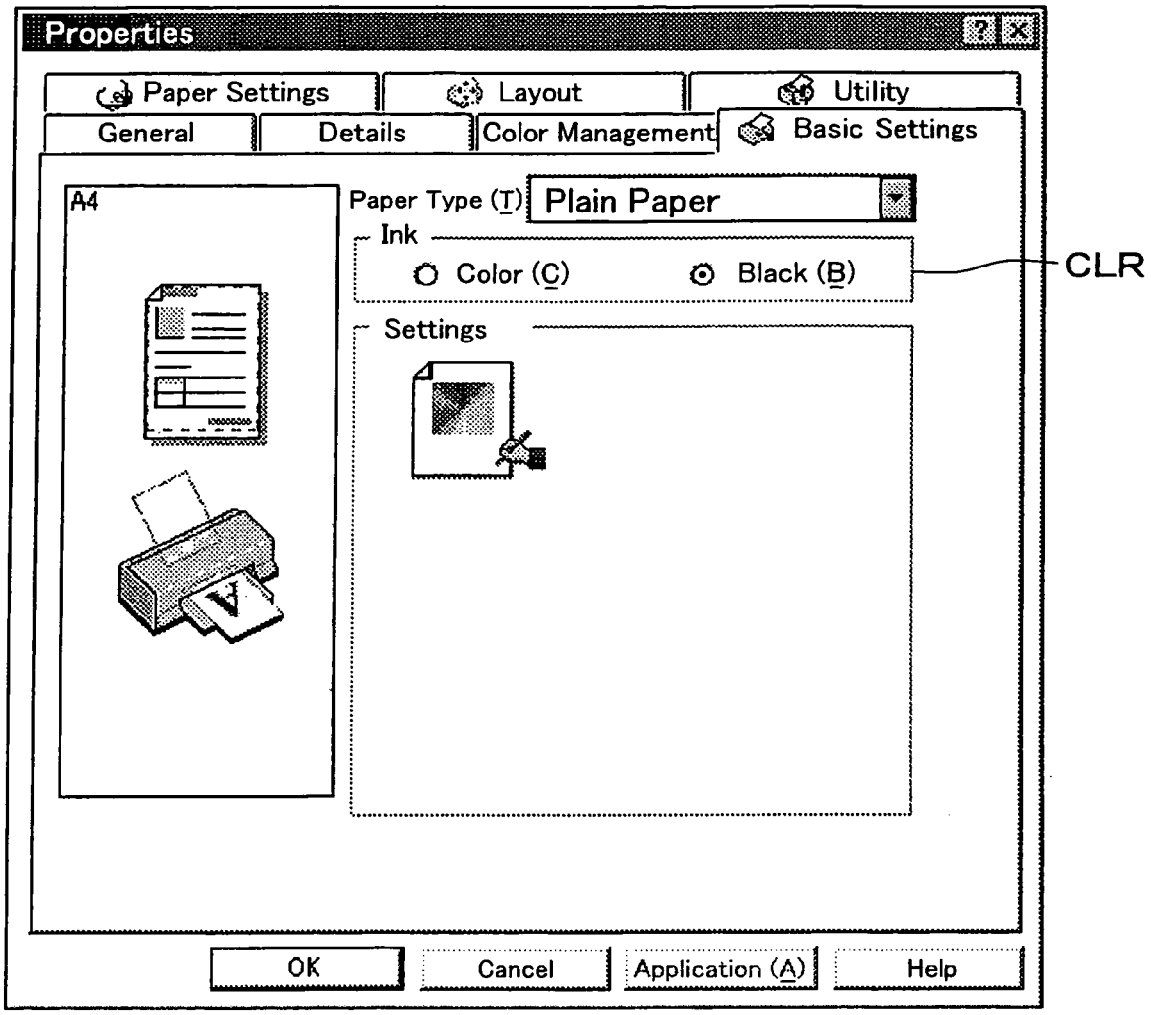
FIG. 10 is a diagram depicting the basic settings screen for print modes in accordance with the first embodiment of the present invention.

FIG. 9 is a flowchart depicting the sequence adopted for performing the printing procedure in accordance with the first embodiment of the present invention. In step S201, the user instructs the computer 90 to start printing. When the property button (not shown) in the print dialog box displayed by the CRT 21 is clicked in step S202, the print mode selector 101 (FIG. 1) causes the property settings screen shown in FIG. 10 to be displayed on the CRT 21.

The user can specify the parameters for defining print modes on the property settings screen. The basic settings screen for print modes shown in FIG. 10 has a menu for defining various parameters and includes an ink color selection button CLR. The ink color selection button CLR is a button used for selecting between the use of color inks and the use of a black ink.

The user can set other parameters on a detailed settings screen for print modes, but these parameters are omitted from the description of the present embodiment.

Once the user selects the ink color and specifies the start of printing in step S203 in FIG. 9, the print data composer 100 (FIG. 1) sets the specifics of a print data composer procedure in accordance with the information received from the print mode selector 101 in step S204. The specifics of the print data composer procedure are set such that high-speed printing is performed using both the supplementary nozzle array S and the black ink nozzle array K if the information received from the print mode selector 101 indicates that, for example, a black ink cartridge 171K has been selected for the supplementary cartridge, and "black" (FIG. 10) has been selected with the ink color selection button CLR.

In step S206 (FIG. 9), the printer driver 96 performs color conversion using the color conversion table LUT selected by the print-mode management process (step S105) shown in FIG. 8, and print data PD are created by performing a print data composition procedure for which processing specifics have been set in step S204 following a halftone procedure. The print data PD are sent from the computer 90 (FIG. 1) to the I/F circuit 50 of the control circuit 40 (FIG. 3) via the connector 56. The printer 20 can print in black and white at a high speed in accordance with the print data PD. Images can be printed in color with super high quality if a dark-yellow ink cartridge 171DY is selected for the supplementary cartridge.

The present embodiment is thus beneficial in the sense that a single printing apparatus can be used as a printing apparatus capable of printing in black and white at a high speed through the use of two nozzle arrays for ejecting black ink, or as a printing apparatus capable of printing in color with super high picture quality through the use of a dark yellow ink by selecting the cartridges to be mounted.

Although the present embodiment was described with reference to a case in which the solution to be fed to the supplementary nozzle array is selected from black and dark yellow inks, a gray ink may also be selected. The printing apparatus of the present embodiment should commonly be configured in a manner that allows the solution fed to the supplementary nozzle array to be selected from a plurality of solutions (including black ink) by selecting the type of supplementary tank to be mounted in the cartridge mounting section. Allowing gray ink to be selected provides the printing apparatus of the present embodiment with a benefit whereby selecting this ink makes it possible to control the color balance non-uniformity that accompanies the production of composite black, and to control the perceived graininess of shadow areas. The term "color balance" refers to the balance among cyan, magenta, and yellow achieved when composite black is formed using color inks. A non-uniform color balance (for example, an excess of cyan) has the drawback of producing a black with a cyan tinge.

C. Printing Procedure of Second Embodiment

The second embodiment is different from the first embodiment in the sense that a cartridge for storing a protective agent (rather than an ink) for protecting the print medium following printing is mounted as the supplementary cartridge. The protective agent is a solution for protecting the printed medium. As will be described below, such protective agents impose limitations as to the types of print media on which these protective agents can be used, and the method for ejecting these agents onto the print media should preferably be controlled in an appropriate manner in accordance with the print medium involved.

FIGS. 11A and 11B are diagrams depicting methods for using protective agents in the printing procedures performed in accordance with the second embodiment of the present invention. FIG. 11A is a diagram depicting methods for using a protective agent X. It can be seen in FIG. 11A that the protective agent X can be used on the print media B–D but cannot be used on the print medium A. When the protective agent X is used on the print medium B, the protective agent X should preferably be ejected concurrently with the ejected ink. When, however, the protective agent X is used on the print media C and D, the preferred procedure would be to eject the protective agent X onto the print mode in advance, and then to perform printing. FIG. 11B is a diagram depicting methods for using another protective agent Y. It can be seen in the drawing that the methods for using protective agents (suitability for the print media and preferred methods for ejecting the protective agents) sometimes vary depending on the type of protective agent.

The printing procedure of the second embodiment also entails performing a preparation procedure for the printing procedure. The preparation procedure is performed according to the flowchart in FIG. 8 in the same manner as in the first embodiment. The only difference from the first embodiment is that the control information that is read from the memory of the cartridge in step S103 contains information on the availability of the protective agents needed to protect a print medium that has undergone printing, and also contains the information needed to eject protective agents such as those shown in the table in FIGS. 11A and 11B.

Figure 12:
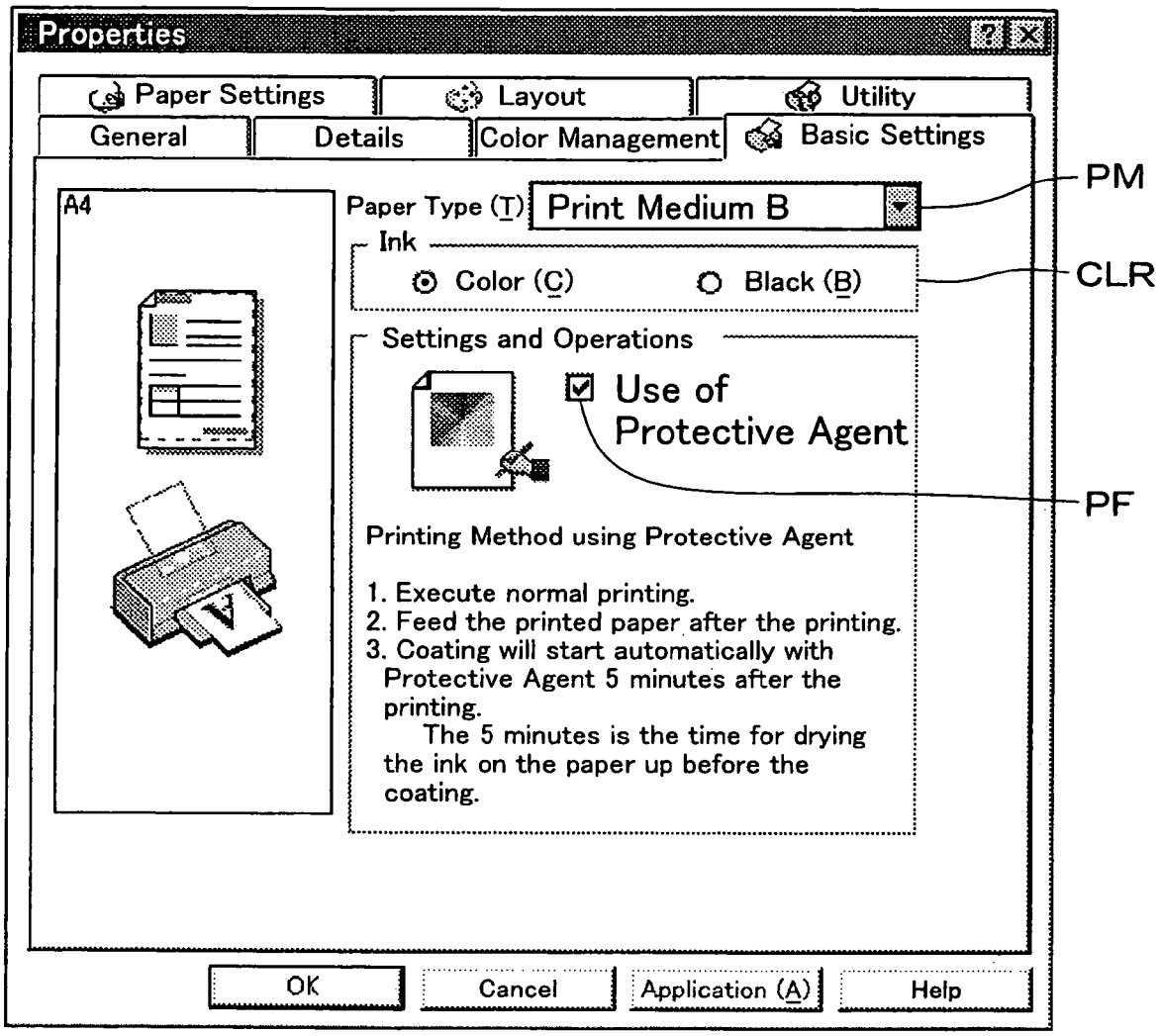
FIG. 12 is a diagram depicting the basic settings screen for print modes in accordance with the second embodiment of the present invention.

FIG. 12 is a diagram depicting the basic settings screen for print modes in accordance with the second embodiment of the present invention. The user can specify the parameters for defining print modes on the property settings screen in the same manner as in embodiment 1. The basic settings screen for print modes in FIG. 12 contains a paper type menu PM and a protective agent use checkbox PF. The paper type menu PM is a pull-down menu for selecting the type of print medium used for printing. The protective agent use checkbox PF is designed to indicate whether a protective agent will be used. In this example, it is assumed that a supplementary cartridge (not shown) for storing a protective agent Y is mounted in the printer 20.

Selecting the print medium B on the paper type menu PM brings up the protective agent use checkbox PF and displays the relevant printing method when a protective agent is to be used. This type of display is adopted because the protective agent Y can be used on the print medium B, as shown in FIG. 11B. This type of display control is performed based on the control information that is read from the memory of the supplementary cartridge used for storing the protective agent. Selecting the print medium C on the paper type menu PM causes the protective agent use checkbox PF to disappear together with the display of the printing method performed when a protective agent is to be used, as can be seen in FIG. 11B.

The user performs printing in accordance with the instructions on the basic settings screen of the print mode. Specifically, a checkmark is first added to the protective agent use checkbox PF. A printing instruction is subsequently issued, and printing is started. The printing paper used in the printing operation is finally inserted into the paper feed slot (not shown). When this is done, ejection of the protective agent onto the printing paper is automatically started five minutes after the printing. The protective agent may, for example, be ejected by the same method as that used for printing solid images with ink. The reason that the protective agent in this example is automatically ejected after five minutes is that applying a large amount of protective agent immediately after printing may result in bleeding or cockling (bending of print media), causing the print head 28 to come into contact with the printing paper. These situations should therefore be avoided. This type of ejection control is performed in accordance with the control data created by agent control data generator 102.

The second embodiment of the present invention is thus advantageous in the sense that the heretofore manually performed step for applying a protective agent can be easily performed using a supplementary nozzle array.

The control information used in the present embodiment should contain information about the availability of the protective agent for protecting the print medium following printing. A description of methods for using this protective agent (suitability for the print media and preferred methods for ejecting the protective agents) should preferably be included in the control information. This is because such an approach is beneficial in the sense that the printing apparatus can be controlled and the protective agent applied by an appropriate method in accordance with the type of protective agent.

Depending on the protection purpose, the protective agent may be a light resistance enhancer, a water resistance enhancer, an antioxidant, or a UV absorber. The protective agent should commonly be a solution for protecting print media. Two broad categories of such agents include luster-imparting materials such as lustering solutions, and delusterant materials such as matting solutions.

Although the above embodiments were described with reference to cases in which the solution fed to the supplementary nozzle array was an ink or a protective agent, it is also possible to use solutions designed to prevent the supplementary nozzle array from drying when not in use, or solutions designed for cleaning the supplementary nozzle array. The solution used in the present invention should commonly be designed to be fed to the supplementary nozzle array.

D. Modifications

The present invention is not limited to the above-described embodiments or embodiments and can be implemented in a variety of ways as long as the essence thereof is not compromised. The following modifications are possible, for example.

D-1. Although the above embodiments were described with reference to the use of a print head equipped with nozzle arrays for ejecting seven types of ink (including light inks), the print head used in the present invention may also be provided with five nozzle arrays (four basic-color nozzle arrays and a supplementary nozzle array). The print head used in the present invention should commonly have basic-color nozzle arrays and a supplementary nozzle array disposed in a staggered manner in relation to the black ink nozzle array, which is a basic-color nozzle array for ejecting black ink.

D-2. Although the above embodiments were described with reference to cases in which the cartridge mounting section was capable of mounting a black ink cartridge, a supplementary cartridge having a supplementary tank, and a color ink cartridge obtained by integrating five ink tanks for storing five types of color ink in a corresponding manner, it is also possible to adopt an arrangement in which, for example, a separate cartridge designated for each type of ink can be mounted. The cartridge mounting section used in the present invention should commonly be capable of mounting a single ink cartridge or a plurality of ink cartridges having a plurality of basic-color ink tanks for storing basic-color inks in a corresponding manner, and a supplementary cartridge with a supplementary tank for storing a solution to be fed to the supplementary nozzle array.

D-3. Although the above embodiments are premised on the mounting of a supplementary cartridge during printing, the printing apparatus of the present invention can also be used to print images without mounting the supplementary cartridge. In the absence of a supplementary cartridge thus mounted, however, measures should preferably be taken to prevent the solution remaining in the supplementary nozzle array or conduit 72 from vaporizing and solidifying. These measures may, for example, involve mounting a dummy cartridge for storing a solution aimed at preventing the supplementary nozzle array from drying. The dummy cartridge should preferably be provided with memory for storing the control information needed to create print data with control information about the use of the solution designed to prevent such drying.

D-4. Although the embodiments described above entail cleaning the color nozzle array with a supplementary ink, another preferred option is to clean the supplementary nozzle array with the aid of a cleaning cartridge for storing the solution designed to clean the supplementary nozzle array when the ink fed to the supplementary nozzle array is replaced with a different type of ink. The cleaning cartridge should preferably be provided with memory for storing the control information needed to create print data with control information about the use of the cleaning solution.

D-5. The printing apparatus of the present invention should preferably be marketed as a combination of a color ink cartridge having basic-color ink tanks, a black ink cartridge having a black ink tank, and a dummy cartridge. Adopting this approach will allow the cartridges to be efficiently used in the following manner in accordance with user preferences.

(1) The printer 20 is purchased together with a black ink cartridge if the goal is to immediately print images in black and white at a high speed.

(2) The printer 20 is purchased together with a dark yellow cartridge or a gray ink cartridge if the goal is to print images in color with super-high picture quality.

(3) The printer 20 alone is purchased and a dummy cartridge is used if the goal is to temporarily print images in a regular manner.

D-6. The cartridge of the present invention should preferably be marketed in combination with a cleaning cartridge and a cartridge for storing an ink or a protective agent. This is because adopting an approach in which a cartridge for storing a protective agent or storing an ink for a supplementary nozzle array is marketed as a combination with a cleaning cartridge is beneficial in the sense that the supplementary nozzle array can be cleaned more efficiently, making it possible to further improve the quality of printed images.

D-7. Although the above embodiments were described with reference to cases in which the type of print medium was specified by selecting the print mode, it is also possible to adopt an approach in which the printing apparatus is provided with means for automatically identifying the type of print medium. The arrangement should preferably entail providing information about the types of print media.

Examples of the means for automatically identifying the type of print medium include optical identification means for detecting and identifying reflected light on the basis of differences between the optical reflectivity levels of specialty paper and plain paper, barcode reading means for performing identifications by reading in advance the barcode on a recording medium or packaging, and means for performing identification with the aid of an IC reader. Such means have the advantage of dispensing with the need for user input to identify the type of print medium, whereas the means for performing identification by selecting a print mode have the advantage of being carried out using a simple structure.

PARA0The present invention can also be adapted to a drum printer. In a drum printer, the direction of drum rotation is the direction of main scanning, and the direction of carriage travel is the direction of sub-scanning. The present invention can be applied not only to an ink-jet printer but also to any common dot-recording device in which images can be recorded on the surface of a print medium with the aid of a recording head having a plurality of nozzle arrays.

PARA0In the above embodiments, software can be used to perform some of the functions carried out by the hardware, or, conversely, hardware can be used to perform some of the functions carried out by the software. For example, the control circuit 40 in the printer 20 can be used to perform some or all of the functions of the printer driver 96 shown in FIG. 1. In this case, the control circuit 40 of the printer 20 performs some or all of the functions of the computer 90 as a print control apparatus designed to create print data.

PARA0When some or all of the functions of the present invention are performed by software, this software (computer programs) can be provided in the form in which it is stored on a computer-readable recording medium. As used in connection with the present invention, the term "computer-readable recording medium" is not limited to a portable recording medium such as a floppy disk or CD-ROM and includes internal computer storage devices (various types of RAM, ROM, and so on) and external storage devices attached to computers (hard disks and so on).

PARA0The present invention can be applicable not only for color printing apparatus but also for black and white printing apparatus. In the black and white printing apparatus, the print head has a black ink nozzle array and the supplementary nozzle array that is offset from the black ink nozzle array in a sub-scan direction.

PARA0Although the present invention has been described and illustrated in detail, it is clearly understood that the same is by way of illustration and example only and is not to be taken by way of limitation, the spirit and scope of the present invention being limited only by the terms of the append claims.

What is claimed is:

1. A print head used for a printing apparatus for printing by ejecting ink drops to form dots, comprising:

a black ink nozzle array ejecting a black ink; and a supplementary nozzle array receiving a supplementary solution independently from the black ink nozzle array, thereby ejecting the supplementary solution;

wherein the supplementary nozzle array is offset from the black ink nozzle array in a sub-scan direction, the offset amount being half of a nozzle pitch in the sub-scan direction.

2. The print head in accordance with claim 1, wherein the supplementary nozzle array is disposed at an end portion of the print head.

3. The print head in accordance with claim 1, further comprising:

a cyan ink nozzle array for ejecting a cyan ink;

a magenta ink nozzle array for ejecting a magenta ink; and a yellow ink nozzle array for ejecting a yellow ink;

wherein the supplementary nozzle array receives the supplementary solution independently further from the cyan ink nozzle array, the magenta ink nozzle array, and the yellow ink nozzle array.

4. The print head in accordance with claim 3, further comprising:

a light-cyan ink nozzle array for ejecting a light-cyan ink having less density than the cyan ink; and a light-magenta ink nozzle array for ejecting a light-magenta ink having less density than the magenta ink;

wherein the supplementary nozzle array receives the supplementary solution independently further from the light-cyan ink nozzle array and the light-magenta ink nozzle array.

* * * * *